United States Patent [19]

Bruder

[11] 4,282,307

[45] Aug. 4, 1981

[54] METHOD FOR FORMING NOBLE METAL SILVER PRECIPITATING NUCLEI

[75] Inventor: Alan H. Bruder, Burlington, Mass.

[73] Assignee: Polaroid Corporation, Cambridge, Mass.

[21] Appl. No.: 80,692

[22] Filed: Oct. 1, 1979

[51] Int. Cl.[3] ..... G03C 1/48; G03C 5/54; F01C 21/16; F03C 3/00

[52] U.S. Cl. ..... 430/232; 423/22; 423/23; 423/42; 428/697; 430/231; 252/317

[58] Field of Search ..... 430/231, 232, 14, 18, 430/9, 228; 252/317; 423/22, 23, 42; 428/539

[56] References Cited

U.S. PATENT DOCUMENTS

| | | | |
|---|---|---|---|
| 2,726,154 | 12/1955 | Land | 430/228 |
| 2,861,885 | 11/1958 | Land | 430/231 |
| 2,944,894 | 7/1960 | Land | 430/228 |
| 3,536,488 | 10/1970 | Land | 430/231 |
| 3,615,426 | 10/1971 | Debruyn | 430/228 |
| 3,615,427 | 10/1971 | Debruyn | 430/228 |
| 3,615,428 | 10/1971 | Weed | 430/228 |
| 3,615,429 | 10/1971 | Weed | 430/228 |
| 3,647,440 | 3/1972 | Rasch | 430/231 |
| 3,894,871 | 7/1975 | Land | 430/228 |
| 4,204,869 | 5/1980 | Byers et al. | 430/434 |

*Primary Examiner*—Richard L. Schilling
*Attorney, Agent, or Firm*—Philip G. Kiely

[57] ABSTRACT

Silver-precipitating nuclei are prepared by partially oxidizing a stannous salt reducing agent with potassium, sodium or ammonium dichromate and then reducing a noble metal salt or complex with said reducing agent.

14 Claims, No Drawings

METHOD FOR FORMING NOBLE METAL SILVER PRECIPITATING NUCLEI

BACKGROUND OF THE INVENTION

Procedures for preparing photographic images in silver by diffusion transfer principles are well known in the art. For the formation of the positive silver images, a latent image contained in an exposed photosensitive silver halide emulsion is developed and almost concurrently therewith, a soluble silver complex is obtained by reaction of a silver halide solvent with the unexposed and undeveloped silver halide of said emulsion. The photosensitive silver halide emulsion is developed with a processing composition in a viscous condition which may be spread between the photosensitive element comprising the silver halide emulsion and a second element which may comprise a suitable silver precipitating layer. The processing composition effects development of the latent image in the emulsion and, substantially contemporaneously therewith, forms a soluble silver complex, for example, a thiosulfate or thiocyanate, with undeveloped silver halide. This soluble silver complex is, at least in part, transported in the direction of the print-receiving layer and the silver thereof is largely precipitated in the silver-precipitating element to form a positive image thereon. Procedures of this description are disclosed, for example, in U.S. Pat. No. 2,543,181 issued to Edwin H. Land. See, also, Edwin H. Land, *One Step Photography,* Photographic Journal, Section A, pp. 7–15, January 1950.

Additive color reproduction may be produced by exposing a photosensitive silver halide emulsion through an additive color screen having filter media or screen elements each of an individual additive color, such as red or green or blue, and by viewing the reversed or positive silver image formed by transfer to a transparent print-receiving element through the same or a similar screen which is suitably registered with the reversed positive image carried by the print-receiving layer.

As examples of suitable film structures for employment in additive color photography, mention may be made of U.S. Pat. Nos. 2,861,885; 2,726,154; 2,944,894; 3,536,488; 3,615,427; 3,615,428; 3,615,429; 3,615,426; and 3,894,871.

The image-receiving elements of the present invention are particularly suited for use in diffusion transfer film units wherein there is contained a positive transfer image and a negative silver image, the two images being in separate layers on a common, transparent support and viewed as a single, positive image. Such positive images may be referred to for convenience as "integral positive-negative images," and more particularly as "integral positive-negative transparencies." Examples of film units which provide such integral positive-negative transparencies are set forth, for example, in the above-indicated U.S. Pat. Nos. 3,536,488; 3,894,871; 3,615,426; 3,615,427; 3,615,428; and 3,615,429.

In general, silver-precipitating nuclei comprise a specific class of adjuncts well known in the art as adapted to effect catalytic reduction of solubilized silver halide specifically including heavy metals and heavy metal compounds such as the metals of Groups IB, IIB, IVA, VIA and VIII and the reaction products of Groups IB, IIB, IVA and VIII metals with elements of Group VIA.

Particularly preferred precipitating agents are noble metals such as silver, gold, platinum, palladium, etc., and are generally provided in a matrix as colloidal particles.

U.S. Pat. No. 3,647,440, issued Mar. 7, 1972 discloses receiving layers comprising finely divided non-silver noble metal nuclei obtained by reducing a noble metal salt in the presence of a colloid or binder material with a reducing agent having a standard potential more negative than −0.30. It is the thrust of the patent that a reducing agent having a standard potential more negative than −0.30 must be used in order to obtain nuclei of a specific, usable size range. It is further illustrated that stannous chloride, which does not fall within the standard potential range, does not produce useful nuclei. The binder materials disclosed include gelatin, polyvinyl pyrrolidone, polymeric latices such as copoly (2-chloro-ethyl-methacrylate-acrylic acid), a mixture of polyvinyl alcohol and the interpolymer of n-butyl acrylate, 3-acryloyloxy-propane-1-sulfonic acid, sodium salt and 2-acetoacetoxyethyl methacrylate, polyethylene latex, and colloidal silica. The amount of colloid binder employed ranges from about 5 to 500 mgs/ft$^2$ with the nuclei ranging from 1 to 200 micrograms/ft$^2$.

Copending application Ser. No. 69,282, filed Aug. 24, 1979 (common assignee) discloses and claims a receiving element for use in an additive color photographic diffusion transfer film unit which comprises a transparent support carrying an additive color screen and a layer comprising noble metal silver-precipitating nuclei and a polymer; wherein the nuclei are present in a level of about 0.1–0.3 mgs/ft$^2$, and said polymer is present at a level of from about 0.5 to 5 times the coverage of said nuclei. Preferably, the noble metal is obtained by reduction of a noble metal salt or complex, and more preferably, the noble metal is palladium. The preferred binder polymers are gelatin and hydroxyethyl cellulose; gelatin at the low end of the nuclei-binder ratio can be employed to provide good density and neutral tone positive images in the receiving layer whereas the preferred levels of other polymers, such as hydroxyethyl cellulose, are at the higher portions of the nuclei-binder range.

Copending application Ser. No. 897,942, filed Apr. 4, 1978, (common assignee) now U.S. Pat. No. 4,168,015 issued Jan. 29, 1980 discloses and claims a receiving element for use in a silver diffusion transfer film unit which comprises a support carrying a layer of noble metal silver-precipitating nuclei in a polymeric binder composition of poly vinyl alcohol and gelatin.

Copending application Ser. No. 897,943, filed Apr. 4, 1978, (common assignee) now U.S. Pat. No. 4,186,013 issued Jan. 29, 1980 discloses and claims a receiving element for use in a silver diffusion transfer film unit which comprises a support carrying a layer of noble metal silver-precipitating nuclei in a binder composition of hydroxyethyl cellulose and gelatin.

Copending application Ser. No. 897,945, filed Aug. 4, 1978 (common assignee) now U.S. Pat. No. 4,204,869 issued May 27, 1980 discloses and claims a method for forming noble metal silver precipitating nuclei which comprises the reduction of a noble metal salt or complex by a stannous salt wherein the stannous salt is partially oxidized prior to said reduction. Air, oxygen and hydrogen peroxide are disclosed as oxidizing agents.

The above-mentioned patents and applications are incorporated herein by reference in their entirety.

SUMMARY OF THE INVENTION

The present invention is directed to a method of forming noble metal silver-precipitating nuclei and to image-receiving elements and film units employing such nuclei. The noble metal silver-precipitating nuclei are prepared by the reduction of a noble metal salt or complex by a stannous salt wherein said stannous salt is partially oxidized with potassium, sodium or ammonium dichromate prior to said reduction.

The noble metal silver-precipitating nuclei are particularly suitable for use in the receiving elements and film units disclosed in copending application Ser. Nos. 897,942 now U.S. Pat. No. 4,186,015 and 897,943 now U.S. Pat. No. 4,186,013.

DETAILED DESCRIPTION OF THE INVENTION

The novel method of the present invention comprises the steps of forming an aqueous solution of a stannous salt reducing agent, contacting said solution with a solution of potassium, sodium or ammonium dichromate to partially oxidize the stannous ion and then adding a noble metal salt or complex, preferably in solution, to said solution of partially oxidized reducing agent, whereby noble metal nuclei are formed. The nuclei may then be incorporated into receiving elements and film units as taught in the above cross-referenced patents and applications.

The positive silver images formed in silver-precipitating layers prepared according to the method of copending application Ser. No. 897,945 now U.S. Pat. No. 4,204,869 possess enhanced densities, particularly in additive color film units. However, the use of the preferred oxidizing agent, oxygen, presents some problems. Oxygen gas represents a safety hazard. In addition, sophisticated equipment is required to monitor the progress of the reaction. Clogging of the oxygen diffusion tube will alter the oxygen flow, altering the bubble size which in turn affects the rate of oxidation of the stannous chloride. Further, if the solution is not nitrogen sparged, the residual oxygen remaining in the reduction solution may introduce a variability into the nuclei formed. In short, by means of the present invention, a greater degree of reproducibility is introduced into the method of forming silver precipitating nuclei. It should be understood that any oxidant will not achieve the advantages described herein. For example, potassium permanganate, ceric salts and potassium iodate do not achieve the results obtained with oxygen or dichromate. In some instances, the use of some oxidizing agents are worse than no oxidation of the reducing agent at all. In this respect, peroxy disulfate and meta vanadate, which are very strong oxidants, are worse than the controls; i.e. no oxidation at all of the reducing agent.

By means of the present invention, the use of dichromate as an oxidant for the stannous salt has substantially minimized the problems associated with the use of oxygen while obtaining improved sensitometric properties in film units employing nuclei prepared by means of this invention. Surprisingly, the introduction of the $Cr^{+3}$ ion into the gelatin-containing silver-precipitating layer produces no adverse effects, even though $Cr^{+3}$ is known as a gelatin hardener.

In a particularly preferred embodiment, the solution preparation prior to the addition of the stannous salt is maintained under a blanket of nitrogen, as is the addition of the noble metal salt or complex, with the dichromate being present only in the stannous salt solution prior to the addition of the noble metal salt.

It is preferable that the $Sn^{+4}/Sn^{+2}$ mole ratio obtained by oxidation range between about 2.5 to 10 and 7.0 to 10; a 4 to 10 ratio is particularly preferred.

The aqueous solution of reducing agent generally contains a polymer binder. Suitable polymers include:

gelatin
methyl cellulose
sodium salt of carboxymethyl cellulose
hydroxymethyl cellulose
hydroxyethyl cellulose
hydroxypropyl cellulose
carboxymethyl hydroxyethyl cellulose
alginic acid, sodium salt
agarose
polyvinyl alcohol
deacetylated chitin Particularly preferred is gelatin. Subsequent to nuclei formation additional polymer such as polyvinyl alcohol or hydroxyethyl cellulose may be added in the manner taught by applications Ser. Nos. 897,942 and 897,943.

The noble metals employed in the present invention include silver, gold, palladium and platinum. Palladium is particularly preferred. Suitable noble metal compounds include:

$K_2PdCl_4$
$PdCl_2$
$H_2PtCl_6$
$AgNO_3$
$HAuCl_4$

The following examples illustrate the novel preparation of silver-precipitating nuclei within the scope of the present invention.

EXAMPLE A

The following solution was prepared:
glacial acetic acid—3.47 g
deionized water—3140 g
20% gelatin solution—3.6 g The thus formed solution was heated to 80° C. and then 1.66 g of $SnCl_2.2H_2O$ was added with stirring and 8 minutes was allowed for dissolution of the stannous chloride. To the stannous chloride reducing solution was added 330 ml of palladous chloride solution ($1.60\times10^{-2}$M $H_2PDCl_4$; pH=1.5) with agitation.

The solution was then cooled to 21° C. and 13.1 g of isopropanol and 3.21 g of a 10% alkyl phenoxypolyoxyethylene ethanol surfactant was added. Stirring was continued and then 350 g of 1% hydroxyethyl cellulose (Natrasol 250M, sold by Hercules, Inc., Wilmington, Del.) was added.

EXAMPLE 1

The following solution was prepared:
glacial acetic acid—3.39 g
deionized water—3000 g
20% gelatin solution—3.48 g The solution was prepared at 81° C. with nitrogen purging and then 1.61 g of $SnCl_2.2H_2O$ was added with stirring and 3 min. allowed for dissolution of the stannous chloride. To the stannous chloride reducing solution was added the amounts of potassium dichromate designated in Table 1 below dissolved in 15 cc of water. Maintaining a blanket of nitrogen one minute after the addition of the potassium dichromate, 315 ml. of a palladous chloride solution ($1.60\times10^{-2}$M $H_2PdCl_4$; pH=1.5) was added with agitation. The solution was then cooled to 21° C. and 13.1 g of isopropanol and 3.21 g of a 10% alkyl phenoxypolyoxyethylene ethanol surfactant was added. Stirring was continued and then 350 g of 1% hydroxyethyl cellulose (Natrasol 250M, sold by Hercules, Inc., Wilmington, Del.) was added.

The following example sets forth an additive color diffusion transfer film unit in which the utility of the nuclei of the present invention was determined.

EXAMPLE B

A film unit was prepared comprising a transparent polyester film base carrying on one surface, an additive color screen of approximately 1500 triplets per inch of red, blue and green filter screen elements in repetitive side-by-side relationship; 328 mgs/ft$^2$ polyvinylidine chloride/polyvinyl formal protective overcoat layer; a nucleating layer comprising palladium nuclei prepared as described above at a coverage of 0.15 mgs/ft$^2$ Pd, 0.15 mgs/ft$^2$ gelatin and 1.0 mgs/ft$^2$ hydroxyethyl cellulose; an interlayer formed by coating 1.9 mgs/ft$^2$ gelatin, 2.3 mgs/ft$^2$ acetic acid and 0.19 mgs/ft$^2$ octylphenoxy polyethoxy ethanol surfactant; a hardened gelatino silver iodobromo emulsion (a 50—50 blend of 0.59$\mu$ and 0.72$\mu$ mean diameter grains) coated at a coverage of about 69.4 mgs/ft$^2$ of gelatin and about 84 mgs/ft$^2$ of silver with about 3.25 mgs/ft$^2$ of propylene glycol alginate and about 0.55 mgs/ft$^2$ of nonyl phenol polyglycol ether (containing 9.5 moles of ethylene oxide); and 18.9 mgs/ft$^2$ of a carboxylated styrene/butadiene copolymer latex (Dow 620, Dow Chemical Company, Midland, Michigan panchromatically sensitized with 5,5'-dimethyl-9-ethyl-3,3'-bis-(3-sulfopropyl) thiacarbocyanine-triethyl-ammonium salt (0.53 mg/g Ag); 5,5'-diphenyl-9-ethyl-3,3'-bis-(4-sulfobutyl) oxacarbocyanine (0.75 mg/g Ag); anhydro 5,6-dichloro-1,3-diethyl-3'-(4''-sulfobutyl)-benzimidazolothiacarbocyanine hydroxide (0.75 mg/g Ag); and 3-(3-sulfopropyl)-3'-ethyl-4,5-benzothia-thiacyanine betaine (1.0 mg/g Ag); red, green, green and blue sensitizers respectively; and the following antihalo top coat. The antihalo top coat referred to below is disclosed and claimed in application Ser. No. 383,261, filed July 27, 1973 (now abandoned).

| Top Coat | mgs/ft$^2$ |
|---|---|
| Gelatin | 400 |
| Dow 620 (carboxylated styrene/butadiene copolymer latex Dow Chemical Co., Midland, Michigan) | 204 |
| Propylene glycol alginate | 25.7 |
| Dioctyl ester of sodium sulfosuccinate | 1.2 |
| Benzimidazole-2-thiol $Au^{+1}$ complex | 5 (as gold) |
| Daxad-11 (polymerized sodium salts of alkyl naphthalene sulfonic acid) Manufactured by W.R. Grace & Co. Cambridge, MA | 0.38 |
| Pyridinium bis-1,5 (1,3-diethyl-2-thiol-5-barbituric acid) pentamethine oxanol (silver complex) | 5.8 |
| 4-(2-chloro 4-dimethylamine benzaldehyde)-1-(p-phenyl carboxylic acid)-3-methyl pyrazolone-5 | 7 |

| Processing Composition | Weight % |
|---|---|
| Sodium hydroxide | 8.3 |
| hydroxyethyl cellulose (sold by Hercules, Inc., Wilmington, Delaware under the tradename Natrosol 250 HH) | 0.6 |
| Tetramethyl reductic acid | 7.0 |
| Potassium bromide | 0.6 |
| Sodium sulfite | 0.8 |
| 2-methylthiomethyl-4,6-dihydroxypyrimidine | 7.0 |
| 4-aminopyrazolo-[3,4d]-pyrimidine | 0.02 |
| N-benzyl-$\alpha$-picolinium bromide (50% solution) | 3.5 |
| Water | 66.6 |
| $Na_2B_4O_7 \cdot 10H_2O$ | 3.3 |
| Glycerine | 1.7 |
| p-isononyl phenoxy poly glycidol (containing about 10 glycidol units) | 0.5 |

Film units prepared according to the above procedure were given an 8 mcs exposure with a Xenon sensitometer and processed with mechanical rollers with an 8 mil gap disposing the processing composition between the top coat and a polyethylene terephthalate cover sheet. The film unit was held in the dark for 1 minute and then the cover sheet was removed, retaining the rest of the film unit together and then air drying. The spectral data was obtained by reading the neutral column to red, green and blue light in an automatically recording densitometer.

TABLE 1

| $K_2Cr_2O_7$ (g) | $Sn^{+4}/Sn^{+2}$ | Red $D_{max}$ | Green $D_{max}$ | Blue $D_{max}$ | Green $D_{min}$ | Green Toe Extent |
|---|---|---|---|---|---|---|
| 0 | 0 | 2.59 | 2.55 | 2.51 | 0.40 | 0.31 |
| 0.071 | 1.6/10 | 2.99 | 2.91 | 2.78 | 0.40 | 0.29 |
| 0.144 | 3.7/10 | 3.18 | 3.03 | 2.94 | 0.39 | 0.25 |
| 0.216 | 6.9/10 | 3.26 | 3.09 | 3.01 | 0.38 | 0.24 |

From the foregoing table it will be seen that partially oxidizing the stannous chloride provides enhanced $D_{max}$ values compared to unoxidized stannous chloride. However, it will be noted that increased amounts of potassium dichromate results in a drop in green toe extent.

A film unit prepared, exposed and processed as above employing nuclei prepared with a $Sn^{+4}/Sn^{+2}$ ratio of 4.5/10 obtained by oxidizing stannous chloride with oxygen showed the following sensitometric data:

Red $D_{max}$—3.08
Green $D_{max}$—3.22
Blue $D_{max}$—3.12
Green $D_{min}$—0.51
Green Toe Extent—0.84

While the $D_{max}$ values are comparable to those obtained with potassium dichromate, the $D_{min}$ is much poorer, although a superior toe extent is obtained with oxygen.

While the invention was described previously in terms of an additive color system, it should be understood that the noble metal nuclei prepared according to the procedure of the present invention are also suitable for use in black and white silver diffusion transfer systems.

The support employed in the present invention is not critical. The support or film base employed may comprise any of the various types of transparent rigid or flexible supports, for example, glass, polymeric films of both the synthetic type and those derived from naturally occurring products, etc. Especially suitable materials, however, comprise flexible transparent synthetic polymers such as polymethacrylic acid, methyl and ethyl esters; vinyl chloride polymers; polyvinyl acetals; polyamides such as nylon; polyesters such as the polymeric films derived from ethylene glycol terephthalic acid; polymer cellulose derivatives such as cellulose acetate, triacetate, nitrate, propionate, butyrate, acetate-butyrate; or acetate propionate; polycarbonates; polystyrenes; and the like.

The additive color screen employed in the present invention may be formed by techniques well known in the art, e.g., by sequentially printing the requisite filter patterns by photomechanical methods. An additive color screen comprises an array of sets of colored areas or filter elements, usually from two to four different colors, each of said sets of colored areas being capable of transmitting visible light within a predetermined wavelength range. In the most common situations the additive color screen is trichromatic and each set of color filter elements transmits light within one of the so-called primary wavelength ranges, i.e., red, green and blue. The additive color screen may be composed of minute dyed particles, such as starch grains or hardened gelatin particles, intermixed and interspersed in a regular or random arrangement to provide a mosaic. A regular mosaic of this type may be made by the alternating embossing and doctoring technique described in U.S. Pat. No. 3,019,124. Another method of forming a suitable color screen comprises multi-line extrusion of the type disclosed in U.S. Pat. No. 3,032,008, the colored lines being deposited side-by-side in a single coating operation. Still another method is set forth in U.S. Pat. No. 3,284,208.

Silver halide solvents useful in forming the desired soluble complex with unexposed silver are well known and, for example, may be selected from the alkali metal thiosulfates, particularly sodium or potassium thiosulfates, particularly sodium or potassium thiosulfates, or the silver halide solvent may be cyclic imide, such as uracil, in combination with a nitrogenous base as taught in U.S. Pat. No. 2,857,274 issued Oct. 21, 1958 to Edwin H. Land or pseudouracils, such as the 4,6-dihydroxypyrimidines. While the silver halide solvent is preferably initially present in the processing composition, it is within this invention to initially position the silver halide solvent in a layer of the film unit, preferably in the form of a precursor which releases or generates the silver halide solvent upon contact with an alkaline processing fluid.

The processing composition may contain a thickening agent, such as an alkali metal carboxymethyl cellulose or hydroxyethyl cellulose, in a quantity and viscosity grade adapted to facilitate application of the processing composition. The processing composition may be left on the processed film or removed, in accordance with known techniques, as is most appropriate for the particular film use. The requisite alkalinity, e.g., a pH of 12–14, is preferably imparted to the processing composition, such as sodium, potassium and/or lithium hydroxide. A wetting agent may be advantageously included in the processing composition to facilitate application thereof, particularly where the processing composition is applied in a very thin layer of low viscosity fluid.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para- or ortho-positions with respect to each other, such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to remove unused silver halide developing agent, development reaction products, etc., the silver halide developing agent(s) should not give rise to colored reaction products which might strain the image or which, either unreacted or reacted, might adversely affect the stability and sensitometric properties of the final image. Particularly useful silver halide developing agents having good stability in alkaline solution are substituted reductive acids, particularly tetramethyl reductic acid, as disclosed in U.S. Pat. No. 3,615,440 issued Oct. 26, 1971 to Stanley M. Bloom and Richard D. Cramer, and $\alpha,\beta$-enediols as disclosed in U.S. Pat. No. 3,730,716 issued to Edwin H. Land, Stanley M. Bloom and Leonard C. Farney on May 1, 1973.

What is claimed is:

1. A method for forming noble metal silver-precipitating nuclei which comprises the steps of (a) forming an aqueous solution of a stannous salt;

(b) contacting said solution with potassium, sodium or ammonium dichromate to partially oxidize said stannous ion; and (c) adding a noble metal salt or complex.

2. The method of claim 1 wherein said aqueous solution includes a polymer.

3. The method of claim 2 wherein said polymer is gelatin.

4. The method of claim 3 wherein a second polymer is added subsequent to nuclei formation.

5. The method of claim 4 wherein said second polymer is hydroxyethyl cellulose.

6. The method of claim 4 wherein said second polymer is polyvinyl alcohol.

7. The method of claim 1 wherein said aqueous solution includes acetic acid.

8. The method of claim 1 which includes the step of coating said nuclei on a support.

9. The method of claim 1 wherein said stannous salt is stannous chloride.

10. The method of claim 1 wherein said noble metal is palladium.

11. The method of claim 1 wherein said steps are carried out under a blanket of nitrogen.

12. The method of claim 1 wherein said stannous salt has been oxidized to provide a ratio $Sn^{+4}$ to $Sn^{+2}$ of about 2.5 to 10 to 7.0 to 10.

13. The method of claim 12 wherein said $Sn^{+4}$ to $Sn^{+2}$ ratio is about 4 to 10.

14. A method for forming a noble metal silver-precipitating element which comprises the steps of (a) forming an aqueous solution of acetic acid and gelatin;

(b) adding to said solution stannous chloride;

(c) adding sufficient potassium dichromate to said solution to provide a $Sn^{+4}$ to $Sn^{+2}$ ratio of about 4 to 10;

(d) adding palladous chloride to said solution; and (e) coating the thus-formed nuclei on a support.

* * * * *